United States Patent [19]

Counts et al.

[11] 3,933,382

[45] Jan. 20, 1976

[54] SECURITY LOCK

[75] Inventors: W. Ray Counts, Golden; Wayne M. Schickedanz, Arvada, both of Colo.

[73] Assignee: Transport Security Systems, Inc., Denver, Colo.

[22] Filed: July 13, 1973

[21] Appl. No.: 379,068

[52] U.S. Cl. ..... 292/144; 70/280; 160/201; 292/201

[51] Int. Cl.[2] ..... E05C 3/06

[58] Field of Search ..... 292/150, 144, 201, DIG. 2; 70/263, 264, 280; 160/201, 195; 49/449

[56] References Cited

UNITED STATES PATENTS

| | | | |
|---|---|---|---|
| 1,343,731 | 6/1920 | Kyle | 70/280 X |
| 1,629,731 | 5/1927 | Peterson | 70/280 X |
| 1,948,217 | 2/1934 | Goodwin, Sr. | 70/280 |
| 2,257,103 | 9/1941 | Brokering | 160/201 X |
| 2,322,088 | 6/1943 | Black | 160/195 |
| 3,234,766 | 2/1966 | O'Brien | 292/144 |
| 3,426,829 | 2/1969 | McDaniel et al. | 160/201 |
| 3,576,119 | 4/1971 | Harris | 292/144 X |
| 3,643,479 | 2/1972 | Solow | 292/144 X |
| 3,751,088 | 8/1973 | Schlage | 292/201 |

*Primary Examiner*—Roy D. Frazier
*Assistant Examiner*—Peter A. Aschenbrenner
*Attorney, Agent, or Firm*—Sheridan, Ross & Fields

[57] ABSTRACT

Electrically operated lock for a closure, such as a truck door, characterized by a bolt movable between locked and unlocked positions and latched against movement in both positions, the bolt movement being under control of a two position switch and other switches which disconnect electrical energization when the bolt moves to either position. The apparatus is located at an inaccessibly position, preferably inside the truck, to prevent tampering therewith from outside the truck.

15 Claims, 4 Drawing Figures

SECURITY LOCK

BACKGROUND OF THE INVENTION

In the transportation of materials by truck between a loading point and a destination, it is common practice to maintain the compartment closure in locked condition by use of a padlock which engages a suitable hasp or the like to prevent theft or tampering with the contents while in transit. In some instances the door is locked at the loading point by authorized personnel and unlocked at the destination by personnel other than the driver, who is not provided with a key, thus obviating suspicion that the driver has unlocked the closure during transit. Such locks are relatively easy to remove by cutting or jimmying. While there is no certainty that the driver may have removed the lock in such manner during transit, he is under a heavy burden to explain why the truck was left unattended at any stopping point to permit theft or pilfering of the contents. As will be apparent, this suspicion could be obviated if a locking system were provided which is jimmy-proof or otherwise tamper-proof by the driver or any other person than the driver.

Electrically operated bolts for locking closures, such as doors, have long been known as exemplified by U.S. Pat. No. 603,321 to Carlton (1898) and U.S. Pat. No. 947,866 to Taylor (1910), these differing in the manner in which control of the bolt was desired. In a further advancement in the art, as exemplified by U.S. Pat. No. 1,558,707 to Milligan (1925), it was recognized that a need existed for a solenoid operated bolt which could be positively latched in its locked and unlocked positions. In this connection, selective energization of two solenoids was apparently under manual control of an operator and one of the solenoids could remain energized after moving the bolt to desired position unless the operator opened a suitable switch. This inadvertence to open the circuit was not only a waste of electrical energy but also could burn up the insulation of a field winding unless it was designated for continuous energization. It is believed apparent that if the circuits could automatically be opened after throwing the bolt to one or the other of its two positions any inadvertence in opening a manually operated switch would be obviated.

Another disadvantage of the Milligan construction appears to reside in the manner in which the bolt locking latch is actuated by magnetic attraction toward the solenoid cores, the flux density in the magnetic circuit being relatively weak due to the large air gap therein. As will be apparent, just prior to release of a latch, it is bucking movement of a core and, hence, the attractive force must be in excess of the axial force on the core. It is believed apparent, accordingly, that it would be advantageous to move the latch under control of an independent actuator so that the actuator could be designed to perform its unlatching function independent of the core moving function and not dependent upon some partially common flux density therebetween.

SUMMARY OF THE INVENTION

The present invention, in one of its forms, most closely resembles the concepts of the Milligan patent referred to in that it employs two solenoids for selectively moving a bolt between locked and unlocked positions and means for locking the bolt in each position. It differs in its broader aspects in that (a) locking or unlocking of the bolt in its two positions is effected by two other solenoids each designed for producing forces independent of bolt moving forces, (b) movement of the bolt between its two positions automatically opens circuits to the bolt moving solenoids, and (c) the opening of the circuits is under control of the two other solenoids referred to. In its more limited aspects, it differs in specific details of orientation of components, construction, and combinations, to be subsequently described in detail.

In other forms of the invention, a reversible electric rotary motor is provided for moving the bolt between its two positions, the motor preferably being connected to the bolt by a self locking drive mechanism, such as a worm and worm wheel, which locks the bolt from movement when the motor is de-energized.

Activation of the solenoids is accomplished through the movement of a two position switch. Advantageously, this switch is controlled by a tumbler lock which can be operated only by authorized personnel having a key therefor.

In accordance with the foregoing, the principal object of the invention includes the provision of:

Effecting movement of a closure locking bolt between locked and unlocked positions under control of a two position electric switch, means for automatically locking the bolt in each position, and means for discontinuing electrical energization of the system when the bolt is moved to one or the other of its positions.

Another object includes the provision of a locking bolt in combination with a container door, such as a truck door, and certain orientations of components relative thereto, to render the bolt tamper-proof.

Still further objects, advantages and salient features will become more apparent from the detailed description to follow, the appended claims, and the attached drawing to now be briefly described.

DETAILED DESCRIPTION OF PREFERRED EMBODIMENT

Figure 1:
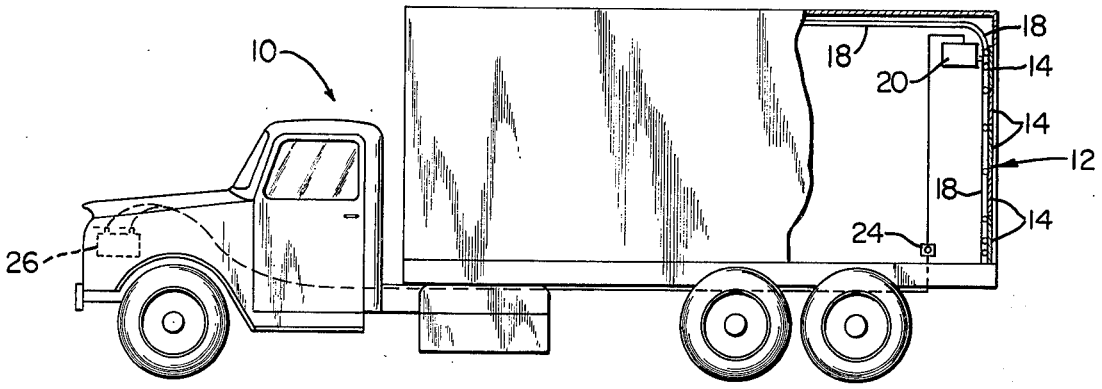
FIG. 1 is a side elevation of a truck, a portion being broken away, depicting an application of the subject invention.
Figure 2:
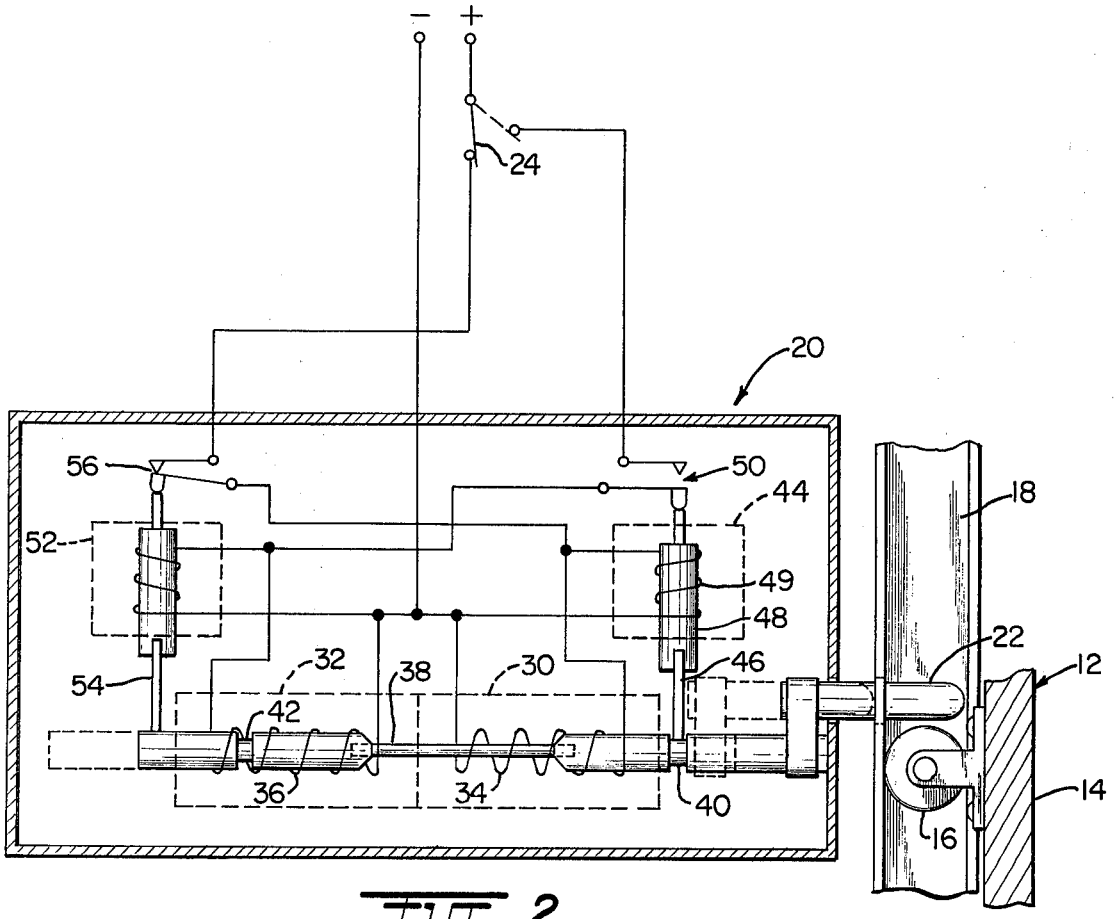
FIG. 2 is a circuit diagram and general arrangement of components of one form of the invention generally depicted in FIG. 1.

Referring first to FIGS. 1 and 2, truck 10 is provided with a door 12, illustrated as the curtain type having articulated sections 14 and side rollers 16 which roll in side channels 18 which extend vertically along the sides of the truck opening and which are curved at their upper ends and thence extend horizontally adjacent the truck roof whereby the sections may be moved to closed position, as shown in FIG. 1, or moved to open position (not shown) adjacent and inside the truck roof.

Locking device 20 is disposed inside the truck near the roof thereof and includes a slideable bolt 22 which may be moved into the path of one of the rollers, best shown in FIG. 2, for preventing upward movement of the door from its closed position. A two position switch 24 is disposed at a convenient position on the truck which is electrically connected between storage battery 26 and the bolt actuator, to now be described. Conveniently, switch 24 can be a part of a tumbler lock which can be operated only by authorized personnel having a key to the same. A suitable lock is the 4901 Ace 10 Tumbler round lock manufactured by Chicago Lock Company of Chicago, Ill.

Referring now to FIG. 2, bolt actuator 20 comprises a rectangular casing which houses first and second axially aligned solenoids 30, 32 having field windings 34, 36, respectively, which move a common core 38, connected to bolt 22 which may be moved into or out of the path of movement of a roller 16. Core 38 is provided with a pair of circular grooves 40, 42, the purpose of which will subsequently appear.

A third solenoid 44, having a locking bar 46 which may drop into groove 40 is associated with solenoid 30, its core 48 being connected to the bar and also associated with a switch 50 adapted to close when bar 46 moves to unlocked position from groove 40. A fourth like solenoid 52, having a like locking bar 54 which may drop into groove 42 is associated with solenoid 32, its core being connected to bar 54 and also associated with switch 56 adapted to open when bar 54 drops into groove 42.

In the operation of the construction just described, it will be assumed that bolt 22 is in the full line door locking position and switch 24 is moved to the full line position. Since switch 56 is now closed, current flows to solenoid field winding 49 and to solenoid field winding 34 which are in parallel. Bar 46 first moves out of locking position with groove 40 after which solenoid 30 moves core 38 and bolt 22 to the left to unlocked position. (Switch 50 is also moved to closed position but at this time is not in circuit with line current.) When bolt 22 moves to its left unlocked position and bar 54 is aligned with groove 42 the bar is free to drop into same, opening switch 56 and opening all circuits even though switch 24 remains in closed position. The reason bar 54 may drop into groove 42 is that solenoid 52 is not energized at this time. When switch 24 is moved to its dotted position, the reverse action takes place. Switch 50 is now closed and solenoids 32 and 52 are energized in parallel. Bar 54 moves out of groove 42 and solenoid 32 moves bolt 22 back to its locked full line position whereupon bar 46 drops into groove 40 (since solenoid 44 is not energized at this time). This, of course, completes the cycle and all circuits are again open even though switch 24 is not moved from its dotted position.

Figure 3:
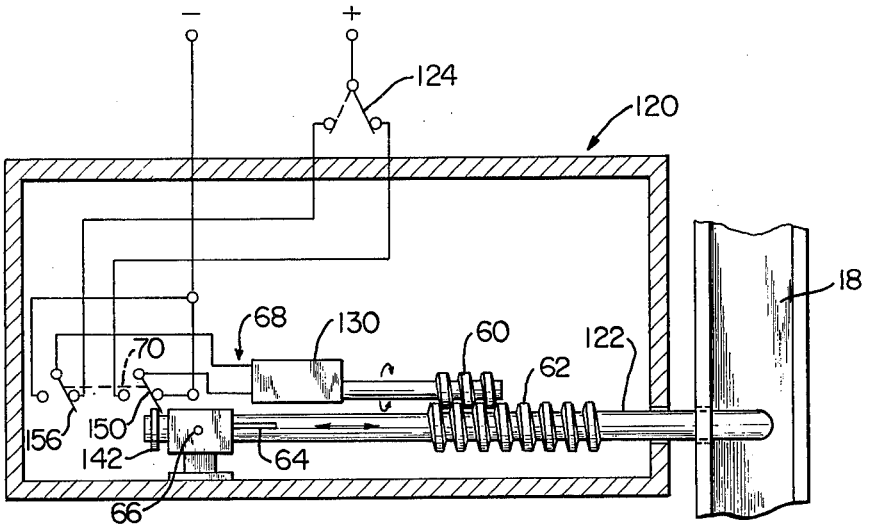
FIG. 3 illustrates an alternative form of bolt actuator.

Referring now to FIG. 3, bolt 122 is rectilinearly moveable relative to side channel 18 between locked and unlocked positions in the same manner as bolt 22, previously described. Actuator 120 differs somewhat in that a reversible direct current motor 130 drives a worm 60 which meshes with a worm wheel 62 which, as illustrated, is of infinite pitch diameter. Preferably, bolt 122 is provided with a longitudinal keyway 64 and a key 66 engageable therewith to prevent rotation of worm wheel 62 but to permit it to move rectilinearly between locked and unlocked positions relative to the door (not shown). Motor 130 is of the direct current reversible type having a pair of input leads 68, the polarity of which may be reversed. For simplicity of disclosure, the motor may be considered as having a permanent magnet field, and a pair of brushes contacting the commutator of the armature which contains suitable windings which, when energized, produce a rotary magnetic field which rotates the armature. Motors of this type are conventional and well known and have advantages in that they are simple and require only reversal of polarity to the brushes to effect rotation of the armature in either of opposite directions. Further, with a permanent magnetic field, no current flows to the armature windings when one of leads 68 is disconnected from the D.C. electrical supply. Two position switches 150, 156 are mechanically connected for conjoint movement by a connecting bar 70. The switches are preferably mico-switches having an "overcenter" actuator which "flips" between two positions upon relatively small movement of the actuator. A collar, pin, or the like 142 is provided on bolt 122 for conjointly flipping the switches between their two positions and a two position manual switch 124 is provided to initiate energization to leads 68. In the operation of this construction it will be assumed that bolt 122 is in unlocked (left) position and switch 124 is moved to the full line position as shown. Motor 130 now rotates, moving the bolt toward locked position. When abutment 142 engages switch 150, switches 150, 156 are flipped to the full line positions which opens the circuit to the motor which comes to rest. When switch 124 is moved to the dotted line position, which reverses polarity to the armature, the bolt moves toward the left until abutment 142 engages switch 156 moving it and switch 150 to their left positions (not shown) which again opens the circuit to the motor, permitting it to come to rest. As will be apparent, abutment 142 provides a lost motion connection between switches 150, 156 which permits bolt 122 to move between slightly less than its full throw. As it approaches the end of its throw, at either end thereof, switches 150, 156 open the circuit and also condition the circuits for reversal of polarity to the motor armature when switch 124 is moved to its other position.

Figure 4:
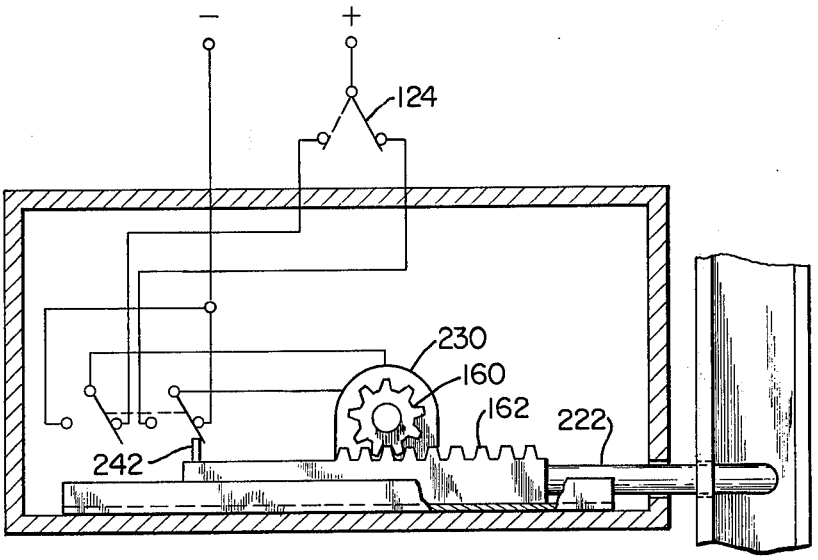
FIG. 4 illustrates another alternative form of bolt actuator.

Referring now to FIG. 4, the circuit is the same as in FIG. 3, but the mechanical connection between motor 230 and bolt 222 is varied somewhat. In this construction, a pinion 160 and a rack 162 are employed in lieu of worm 60 and worm wheel 62. Since this connection is not self-locking when the motor is at rest, it is preferred that it be made so by providing a self-locking reduction gearing between the motor armature and pinion 160, for example, a worm on the armature shaft which engages a worm wheel affixed to the pinion drive shaft. Motor-reduction gear units of this type are well known and have the advantage in that the motor may be of the high speed type with attendant reduction in size for a desired power output.

As will now be apparent, the several embodiments disclosed have an overall operation which is the same in that:

1. When the manual control switch is moved to one of its positions and retained thereat, the bolt automatically moves from one of its positions to the other.

2. When the bolt moves to its other position, the circuit is automatically opened and the manual switch becomes inoperative until it is moved to its other position.

3. When the bolt comes to rest at either of its two positions, a circuit is established which may move the bolt in the opposite direction when the manual switch is moved to its other position.

The invention has been illustrated on an articulated truck door for purposes of illustration. However, it will be apparent to one skilled in the art that the lock can be used with sliding doors, as well, and in connection with a closure for any container for which security is desired, such as boxcars.

The invention has been described in detail with particular reference to preferred embodiments thereof, but it will be understood that variations and modifications can be effected within the spirit and scope of this invention.

We claim:

1. In a lock for use with a moveable closure or the like having a two position bolt adapted to move into the path of movement of the closure to a locked position to prevent movement thereof or move out of the path of movement of the closure to unlocked position to permit movement thereof, the improvements, comprising:

a. electric motor means including a pair of solenoids adapted to be selectively energized for moving the bolt between its two positions, b. means for preventing movement of the bolt when disposed at its two positions, c. a two position control switch for energizing the motor means for selectively causing same to move the bolt between its two positions, and d. other switch means operated by movement of the bolt for de-energizing the motor means when the bolt moves to its two positions.

2. Apparatus in accordance with claim 1, wherein said other switch means establishes a circuit for moving the bolt from one of its positions to the other when the control switch is moved to its other position.

3. Apparatus in accordance with claim 1 including means for preventing movement of the bolt when disposed at its two positions.

4. Apparatus in accordance with claim 3 including other switch means operated by movement of the bolt for deenergizing the motor means when the bolt moves to its two positions.

5. Apparatus in accordance with claim 1, wherein said closure is disposed at the rear end of a truck and constructed as an articulated curtain adapted to be guided by side rails from a vertical closed position thereat to a horizontal open position adjacent and beneath the roof of the truck.

6. Apparatus in accordance with claim 5 wherein the lock is disposed near the roof of the truck.

7. Apparatus in accordance with claim 5 wherein said bolt slideably extends through an opening in one of said rails and moves between blocked and unblocked positions relative to an abutment, such as a roller, carried by the closure.

8. Apparatus in accordance with claim 7 wherein the lock is disposed inside the truck near the roof thereof.

9. Apparatus in accordance with claim 8 wherein the electric motor means is energized by a battery carried by the truck.

10. In a lock for use with a movable closure or the like having a two position bolt adapted to move into the path of movement of the closure to a locked position to prevent movement thereof or move out of the path of movement of the closure to unlocked position to permit movement thereof, the improvements comprising:

a. a first solenoid having a movable core connected to the bolt for moving it to locked position, b. a second solenoid having a movable core connected to the bolt for moving it to unlocked position, c. a third solenoid having a movable core and means operable thereby for releasing said locking bolt from locked position, d. a fourth solenoid having a movable core and means operable thereby for releasing said locking bolt from unlocked position, e. a control switch for selectively energizing either said first and fourth solenoids or said second and third solenoids to move the bolt between locked and unlocked positions, f. each of said third and fourth solenoids having a switch movable thereby to open a circuit when it moves to its locked position so that all solenoids are de-energized to obviate application of continued electrical energy after the bolt is in either of its two positions.

11. Apparatus in accordance with claim 10 wherein: the cores of the first and second solenoids are axially aligned and connected to form a common core with a pair of field windings surrounding same and so wound to selectively move the bolt between its two positions.

12. Apparatus in accordance with claim 10 wherein: the bolt is disposed at one side of the core and moves parallel therewith.

13. Apparatus in accordance with claim 10 wherein: the cores of the third and fourth solenoids are moved toward locking position when de-energized.

14. Apparatus in accordance with claim 13 wherein: the cores of the third and fourth solenoids are oriented in substantially vertical positions and drop by urge of gravity to their locking positions.

15. Apparatus in accordance with claim 10 wherein: the cores of the first and second solenoids are axially aligned to form a common core with a pair of field windings surrounding same and so wound to selectively push or pull the bolt between its two positions, said common core having a pair of axially spaced depressions therein each being selectively engagable by the means operable by the third and fourth solenoids respectively.

* * * * *